US007788863B2

(12) United States Patent
Pepper et al.

(10) Patent No.: US 7,788,863 B2
(45) Date of Patent: Sep. 7, 2010

(54) ASTRAGAL BOOT

(75) Inventors: Michael E. Pepper, Richmond, IN (US); James W. Meeks, Eaton, OH (US); Brian S. Hewitt, Eaton, OH (US)

(73) Assignee: Quanex Corporation, Houston, TX (US)

( * ) Notice: Subject to any disclaimer, the term of this patent is extended or adjusted under 35 U.S.C. 154(b) by 861 days.

(21) Appl. No.: 11/244,786

(22) Filed: Oct. 6, 2005

(65) Prior Publication Data

US 2007/0079557 A1 Apr. 12, 2007

(51) Int. Cl.
*E06B 1/04* (2006.01)
*E06B 1/70* (2006.01)
*E04C 2/38* (2006.01)

(52) U.S. Cl. ..... 52/207; 52/206; 52/211; 52/717.01; 49/467; 49/504

(58) Field of Classification Search ..... 52/206, 52/207, 204.1, 211, 301, 717.01; 49/467, 49/504

See application file for complete search history.

(56) References Cited

U.S. PATENT DOCUMENTS 3,360,887 A * 1/1968 Parks et al. ..... 49/490.1
4,387,535 A * 6/1983 Corbo ..... 49/468
4,429,493 A * 2/1984 St. Aubin ..... 49/367
D273,090 S * 3/1984 Imperial ..... D8/400
4,573,287 A 3/1986 Hagemeyer et al.
4,644,696 A * 2/1987 Bursk ..... 49/367
4,956,940 A * 9/1990 Touton, III ..... 49/388
5,396,735 A * 3/1995 Dietrich ..... 49/499.1
5,481,076 A * 1/1996 Mullet et al. ..... 200/61.43
5,857,291 A 1/1999 Headrick
5,943,825 A * 8/1999 Procton et al. ..... 49/469
6,052,949 A * 4/2000 Procton et al. ..... 49/506
6,219,971 B1 4/2001 Headrick
6,491,326 B1 * 12/2002 Massey et al. ..... 292/162
6,637,158 B2 * 10/2003 Bennett ..... 49/504
6,666,486 B1 12/2003 Fleming
6,763,639 B2 * 7/2004 Bennett et al. ..... 52/212
7,140,154 B2 * 11/2006 Governale et al. ..... 52/207
D541,629 S * 5/2007 Pepper et al. ..... D8/331
D544,337 S * 6/2007 Pepper et al. ..... D8/331

(Continued)

FOREIGN PATENT DOCUMENTS

EP 304592 A1 * 3/1989

*Primary Examiner*—Robert J Canfield
(74) *Attorney, Agent, or Firm*—Howard & Howard Attorneys PLLC

(57) ABSTRACT

An astragal boot is mounted onto a lower end of an astragal disposed on a free end of a semi-active door in a double-door set disposed over a threshold. The astragal boot includes a platform and a pair of lateral fins spaced from one another and being flexible and projecting downwardly from the platform to seal against the threshold. Primary fins are flexible and project downwardly from the platform a greater distance than the lateral fins and are joined to and extend between the lateral fins. The lateral fins are joined to the primary fins and hold the primary fins into sealing engagement with the threshold to prevent the penetration of water between the astragal boot and the threshold. The lateral fins hold the primary fins against the threshold because the primary fins are thinner thereby minimizing the effort required to close the semi-active door over the threshold.

23 Claims, 7 Drawing Sheets

U.S. PATENT DOCUMENTS

| | | | | |
|---|---|---|---|---|
| 7,263,808 | B2 * | 9/2007 | Massey et al. | 52/204.1 |
| 2003/0052492 | A1 * | 3/2003 | Massey et al. | 292/341.15 |
| 2004/0128925 | A1 * | 7/2004 | Massey | 52/204.1 |
| 2004/0139667 | A1 * | 7/2004 | Massey et al. | 52/204.1 |
| 2004/0256858 | A1 * | 12/2004 | Governale et al. | 292/1 |
| 2005/0116424 | A1 | 6/2005 | Sanders | |
| 2005/0120630 | A1 * | 6/2005 | Sanders | 49/365 |
| 2005/0120631 | A1 * | 6/2005 | Sanders | 49/367 |
| 2005/0193784 | A1 | 9/2005 | Sanders | |
| 2005/0198911 | A1 * | 9/2005 | Baczuk et al. | 49/504 |
| 2006/0150517 | A1 * | 7/2006 | Meeks et al. | 49/368 |
| 2008/0028701 | A1 * | 2/2008 | White | 52/207 |
| 2008/0229668 | A1 * | 9/2008 | Meeks et al. | 49/367 |

* cited by examiner

FIG - 6
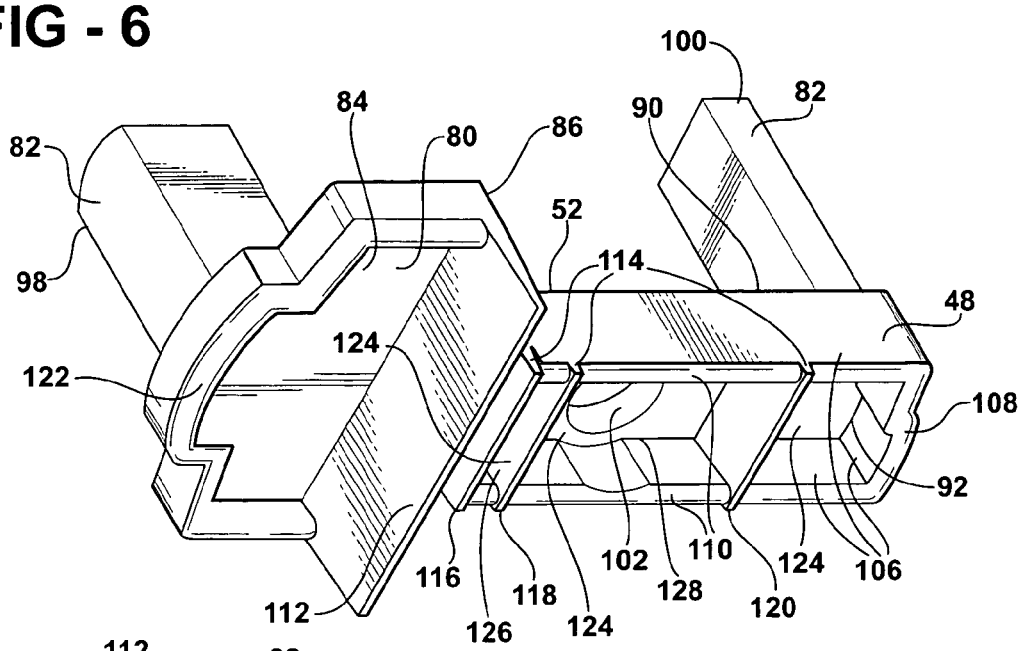
FIG - 7
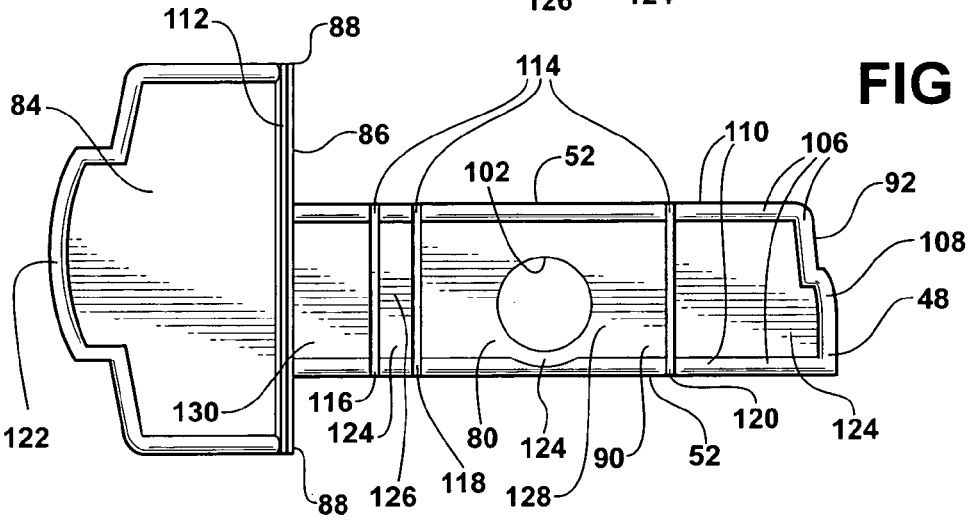
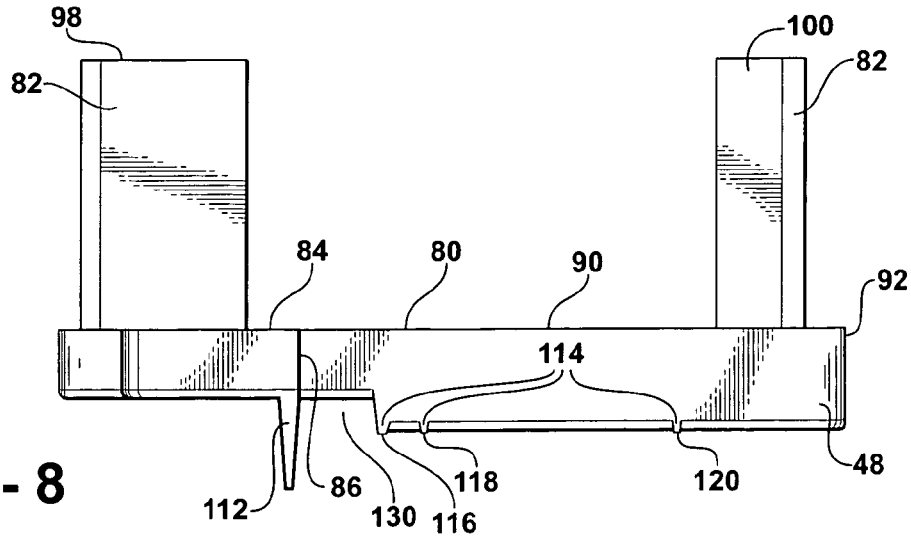
FIG - 8

ASTRAGAL BOOT

BACKGROUND OF THE INVENTION

1. Field of the Invention

The present invention relates to an astragal boot for mounting onto a lower end of an astragal disposed at a free end of a semi-active door in a double-door set disposed over a threshold.

2. Description of the Related Art

Various astragal assemblies are known in the prior art to include an astragal and an astragal boot attached to the astragal. The astragal assembly is disposed between an active door and a semi-active door of a double-door set. The double door set is disposed over a threshold in a door opening of a building.

Typically, the astragal is mounted onto a free end of the semi-active door such that the astragal moves with the free end as the semi-active door is swung between an open position and a closed position. The astragal presents a lower end proximal to the threshold when the semi-active door is in the closed position and walls extending upwardly from the lower end defining a profile.

The astragal boot typically includes a platform and a plurality of projections complementary to the profile projecting upwardly from the platform into engagement with the walls for retaining the astragal boot to the lower end of the astragal.

Door sweeps are mounted on a bottom edge of the semi-active door and the active door. The door sweeps seal between the bottom edge of the doors and the threshold to prevent penetration of elements, i.e. water, draft, and debris, into the building. The prior art discloses an astragal boot that includes fins extending downwardly from the platform of the astragal boot to overlap the door sweeps on the semi-active door and the active door and to seal against the threshold. Specifically, U.S. Patent Application Publication 2004/0256858 to Governale discloses an astragal boot including a platform and two head fins projecting downwardly from the platform to overlap and engage the door sweeps on the active door and the semi-active door and to seal against the threshold. The head fins are flexible to flex against the threshold to seal against the threshold and to minimize the effort required to close the semi-active door over the threshold. A pair of lateral fins are spaced from one another and project downwardly from the platform and perpendicularly to the head fins. The lateral fins are not joined to the head fins. Because the head fins are flexible, it is possible for water to leak between the head fins and the door sweeps. In addition, due to the flexibility of the head fins, it is possible for the head fins to be obstructed by debris thereby preventing a water-tight seal against the threshold and allowing water to leak past the head fins. Because the lateral fins are not joined to the head fins, water that leaks past the head fins may leak into the building between the astragal boot and the threshold.

It is desirable to manufacture an astragal boot that seals between the door sweeps on the active door and the semi-active door while also providing a water-tight seal between the astragal boot and the threshold to prevent the penetration of water between the astragal boot and the threshold. In addition, it is desirable to manufacture an astragal boot that seals against the threshold while minimizing the effort required to close the semi-active door.

SUMMARY OF THE INVENTION AND ADVANTAGES

The present invention is an astragal boot for mounting onto a lower end of an astragal disposed on a free end of a semi-active door in a double-door set disposed over a threshold. The astragal boot includes a platform and a pair of spaced lateral fins. The spaced lateral fins are flexible and project downwardly from the platform for sealing engagement with the threshold. The astragal boot includes a first primary fin being flexible and projecting downwardly from the platform a greater distance than the lateral fins. The first primary fin is joined to and extends between the lateral fins for flexing against the threshold in sealing engagement with the threshold to form a cavity between the lateral fins and the first primary fin and the platform for disposition over the threshold.

Accordingly, the first primary fin provides a water-tight seal against the threshold because the first primary fin is joined to and extends between the lateral fins. Additionally, because the first primary fin projects downwardly from the platform a greater distance than the lateral fins, the lateral fins hold the first primary fin into sealing engagement with the threshold as the first primary fin flexes against the threshold to seal against the threshold. The lateral fins hold the first primary fin into engagement with the threshold because the first primary fin is thinner than the lateral fins thereby minimizing the effort required to close the semi-active door over the threshold.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 6 is a perspective view of an astragal boot;

FIG. 7 is a bottom view of the astragal boot shown in FIG. 6;

FIG. 8 is a front view of the astragal boot shown in FIG. 6; and

DETAILED DESCRIPTION OF THE INVENTION

Referring to the Figures, wherein like numerals indicate corresponding parts throughout the several views, an astragal assembly is shown generally at 20.

Figure 1:
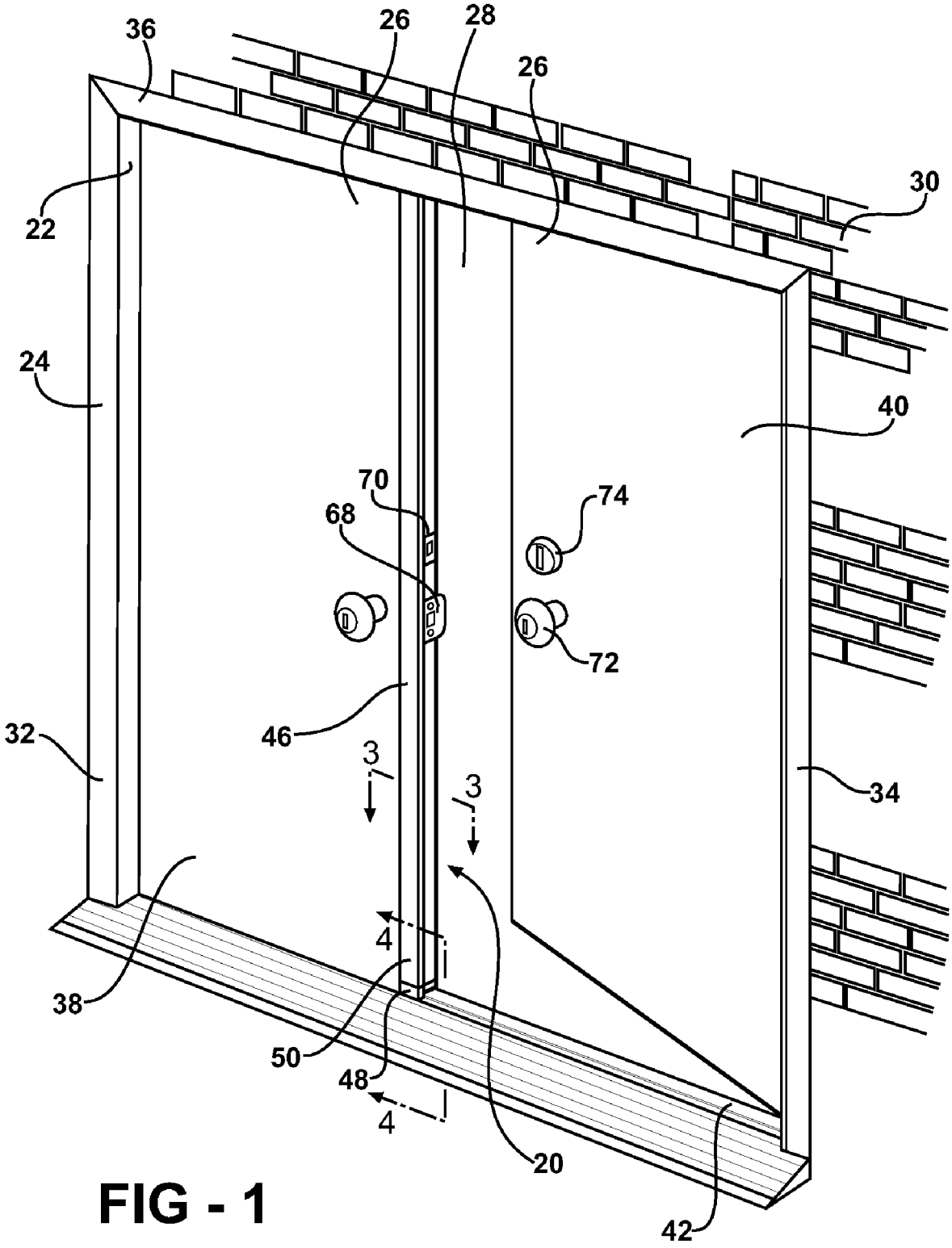
FIG. 1 is a perspective view of an astragal assembly disposed in a door assembly.

As shown in FIG. 1, the astragal assembly 20 is mounted in a door assembly 22. The door assembly 22 includes a frame 24 and a double-door set 26 mounted to the frame 24. More specifically, the frame 24 is mounted in a door opening of a building 30, such as a commercial or residential building 30, and includes a first vertical member 32, a second vertical member 34 spaced from and in parallel with the first vertical member 32, and a header 36 extending between the first vertical member 32 and the second vertical member 34. The double-door set 26 includes a semi-active door 38 rotatably mounted to the first vertical member 32 of the frame 24 and an active door 40 rotatably mounted to the second vertical member 34 of the frame 24. The semi-active door 38 and the active door 40 may rotate relative to the first vertical member 32 and the second vertical member 34, respectively, such that the doors 38, 40 may independently swing between an open position and a closed position. A threshold 42 is mounted in the door opening 28 of the building 30 below the door assembly 22 such that the threshold 42 extends between the first vertical member 32 and the second vertical member 34 of the frame 24.

Figure 2:
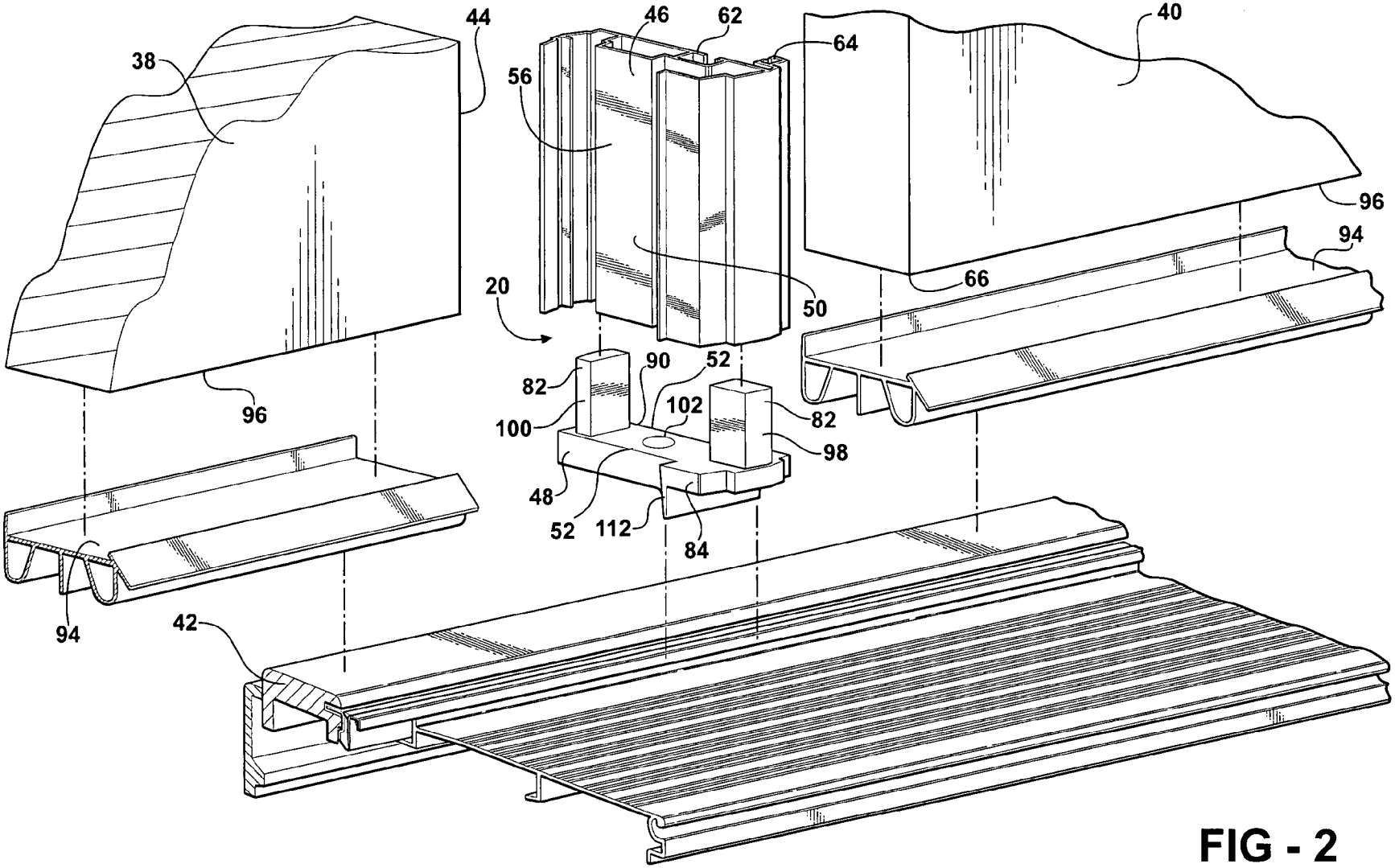
FIG. 2 is a partial exploded view of the astragal assembly and the door assembly shown in FIG. 1 with doors of the door assembly in a closed position.

As seen in FIG. 2, the astragal assembly 20 is disposed on a free end 44 of the semi-active door 38 in the double-door set 26 disposed over the threshold 42. The astragal assembly 20 includes an astragal 46 disposed on the free end 44 of the semi-active door 38 in the double-door set 26 disposed over the threshold 42 and an astragal boot 48 for mounting onto a lower end 50 of the astragal 46. The astragal assembly 20 extends between the active door 40 and the semi-active door 38 from the threshold 42 to the header 36 when the doors 38, 40 are in the closed position. More specifically, the astragal boot 48 seals against the threshold 42 and the astragal 46 extends upwardly from the astragal boot 48 to the header 36 between the doors 38, 40.

Figure 3:
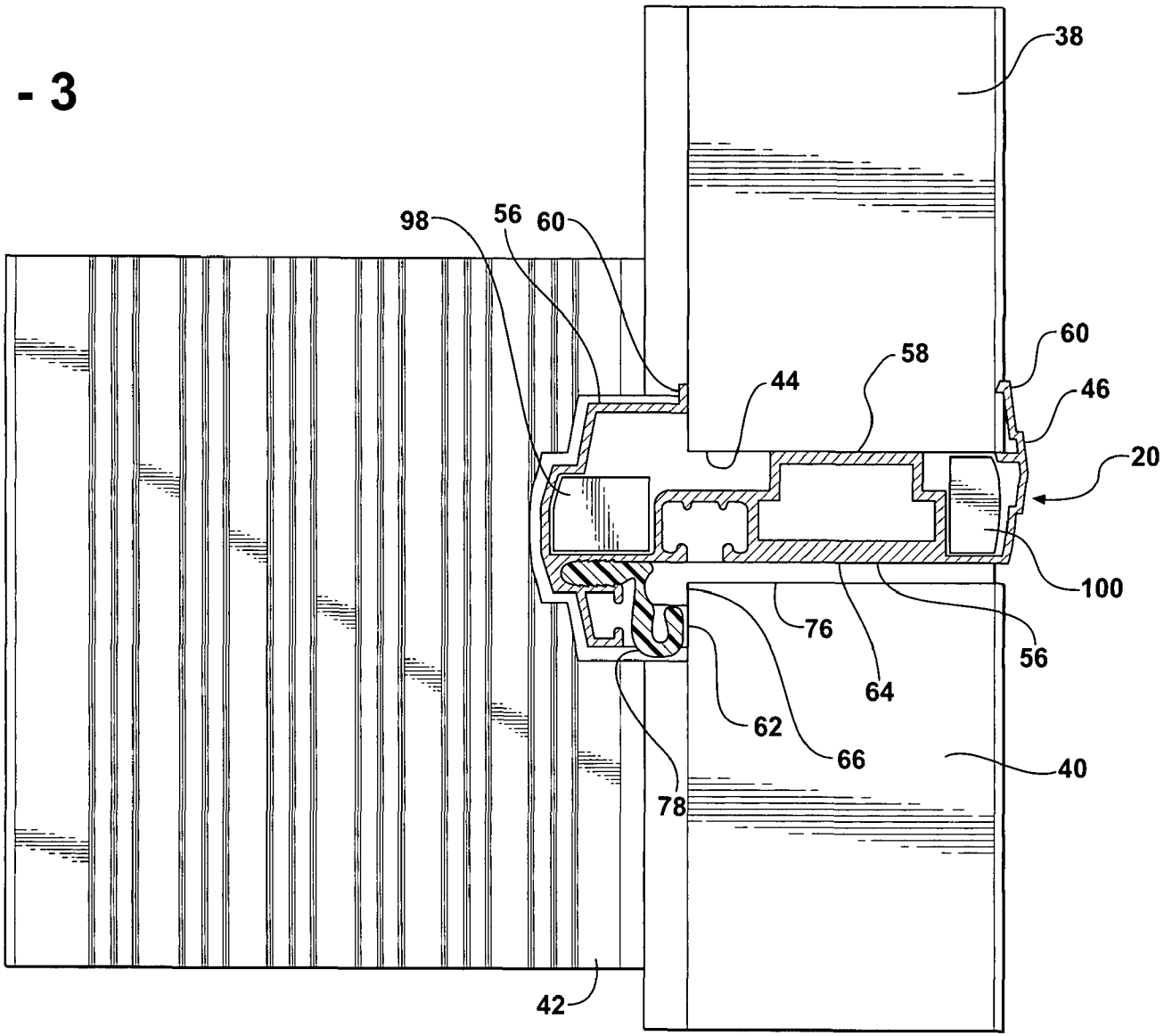
FIG. 3 is a partial cross-sectional view of the astragal assembly and the door assembly generally taken along line 3-3 in FIG. 1 with doors of the door assembly in the closed position.
Figure 4:
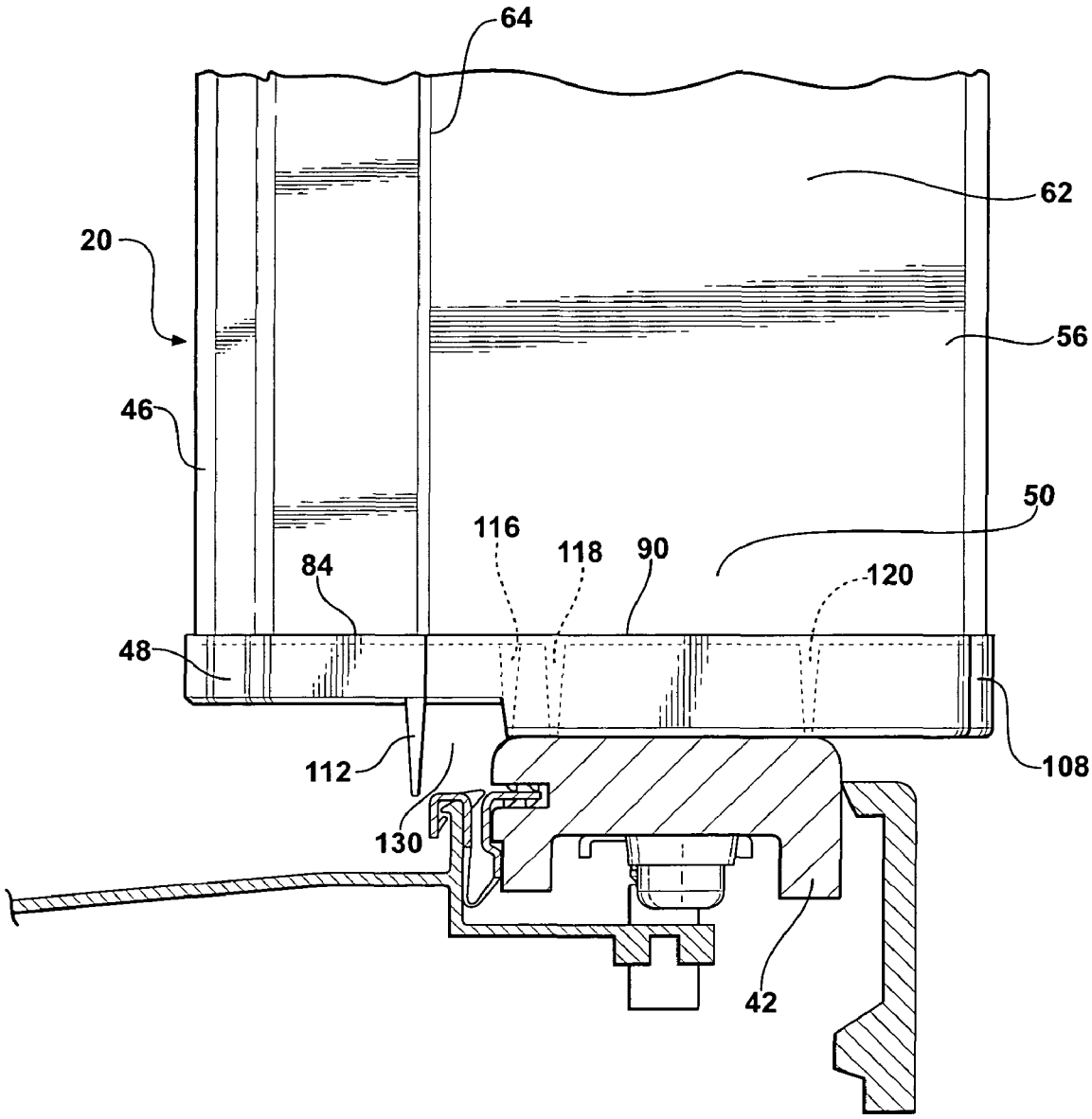
FIG. 4 is a partial cross-sectional view of the astragal assembly and the door assembly taken along line 4-4 in FIG. 1.
Figure 5:
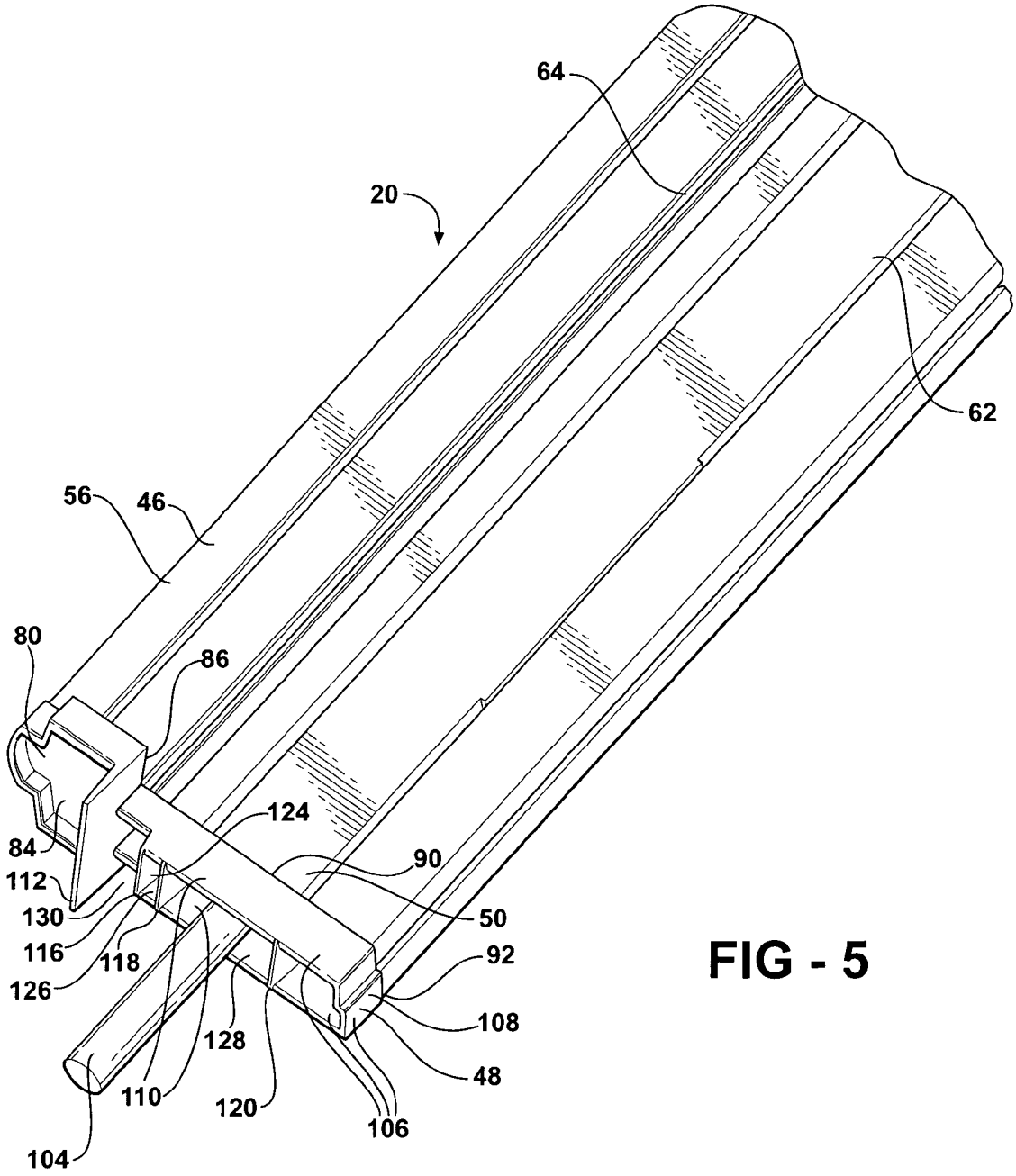
FIG. 5 is a perspective view of a portion of the astragal assembly.

As shown in FIG. 3, the astragal 46 presents a lower end 50 proximal to the threshold 42 and walls 56 extending upwardly from the lower end 50 defining a profile 58. The profile 58 includes a pair of opposing fingers 60 that engage the semi-active door 38 to attach the astragal 46 to the free end 44 of the semi-active door 38. The astragal 46 is attached to the semi-active door 38 such that the astragal 46 moves with the free end 44 of the semi-active door 38 when the semi-active door 38 is swung between the open position and the closed position. The astragal 46 presents a first inside surface 62 and a second inside surface 64 perpendicular to and extending from the first inside surface 62 such that a corner 66 of the active door 40 abuts the first inside surface 62 and the second inside surface 64 when the active door 40 and the semi-active door 38 are in the closed position.

A strike plate 68 and a deadbolt strike 70 are mounted on the first inside surface 62 of the astragal 46. The strike plate 68 is aligned along the first inside surface 62 to receive a latch from a door knob assembly on the active door 40 when the active door 40 and the semi-active door 38 are in the closed position. When both the active door 40 and the semi-active door 38 are in the closed position, the latch from the door knob assembly engages the strike plate 68 on the semi-active door 38 to engage the active door 40 to the semi-active door 38. A door knob 72 on the door knob assembly may be turned to disengage the latch from the strike plate 68 thereby disengaging the active door 40 from the semi-active door 38. Likewise, the deadbolt strike 70 is aligned along the first inside surface 62 to receive a deadbolt from a deadbolt assembly 74 on the active door 40 when the active door 40 and the semi-active door 38 are in the closed position and the deadbolt is in a locked position.

As shown in FIG. 3, a corner pad 76 is attached to the first inside surface 62 of the astragal 46 and to the astragal boot 48. The corner pad 76 contacts the threshold 42 when the semi-active door 38 is in the closed position. A weather seal 78 extends along the second inside surface 64 of the astragal 46. When the semi-active door 38 and the active door 40 are in the closed position the corner pad 76 and the weather seal 78 prevent the elements, i.e. water, draft, and debris, from penetrating between the active door 40 and the astragal 46.

As shown in FIGS. 6-8, the astragal boot 48 includes a platform 80 and a plurality of projections 82 projecting upwardly from the platform 80. The platform 80 is defined by a head portion 84 presenting a straight edge 86 having opposite ends 88 and a base portion 90 having sides 52 narrower than the head portion 84 extending from the straight edge 86 along an axis generally perpendicular to the straight edge 86 to a curved distal extremity 92 for receiving door sweeps 94 adjacent each of the sides 52 of the base portion 90. It should be appreciated that the head portion 84 extends generally perpendicular to the base portion 90 and the angle between the head portion 84 and the base portion 90 is not limited to a 90° angle. The door sweeps 94, as shown in FIG. 2, extend along a bottom edge 96 of each door and seal between the bottom edge 96 of each door and the threshold 42 when the doors 38, 40 are in the closed position for preventing elements from penetrating between the astragal boot 48 and the doors 38, 40 into the building 30. More specifically, the door sweep 94 on the semi-active door 38 extends along the bottom edge 96 of the semi-active door 38 between the first vertical member 32 of the frame 24 and the corner pad 76. Likewise, when both the semi-active door 38 and the active door 40 are in the closed position, the door sweep 94 on the bottom edge 96 of the active door 40 extends along the bottom edge 96 of the active door 40 between the second vertical member 34 of the frame 24 to the astragal 46 and the astragal boot 48. The door sweeps 94 contact and seal against the sides 52 of the base portion 90 of the platform 80 to prevent the elements from penetrating between the door sweeps 94 and the astragal boot 48 into the building 30.

Figure 9:
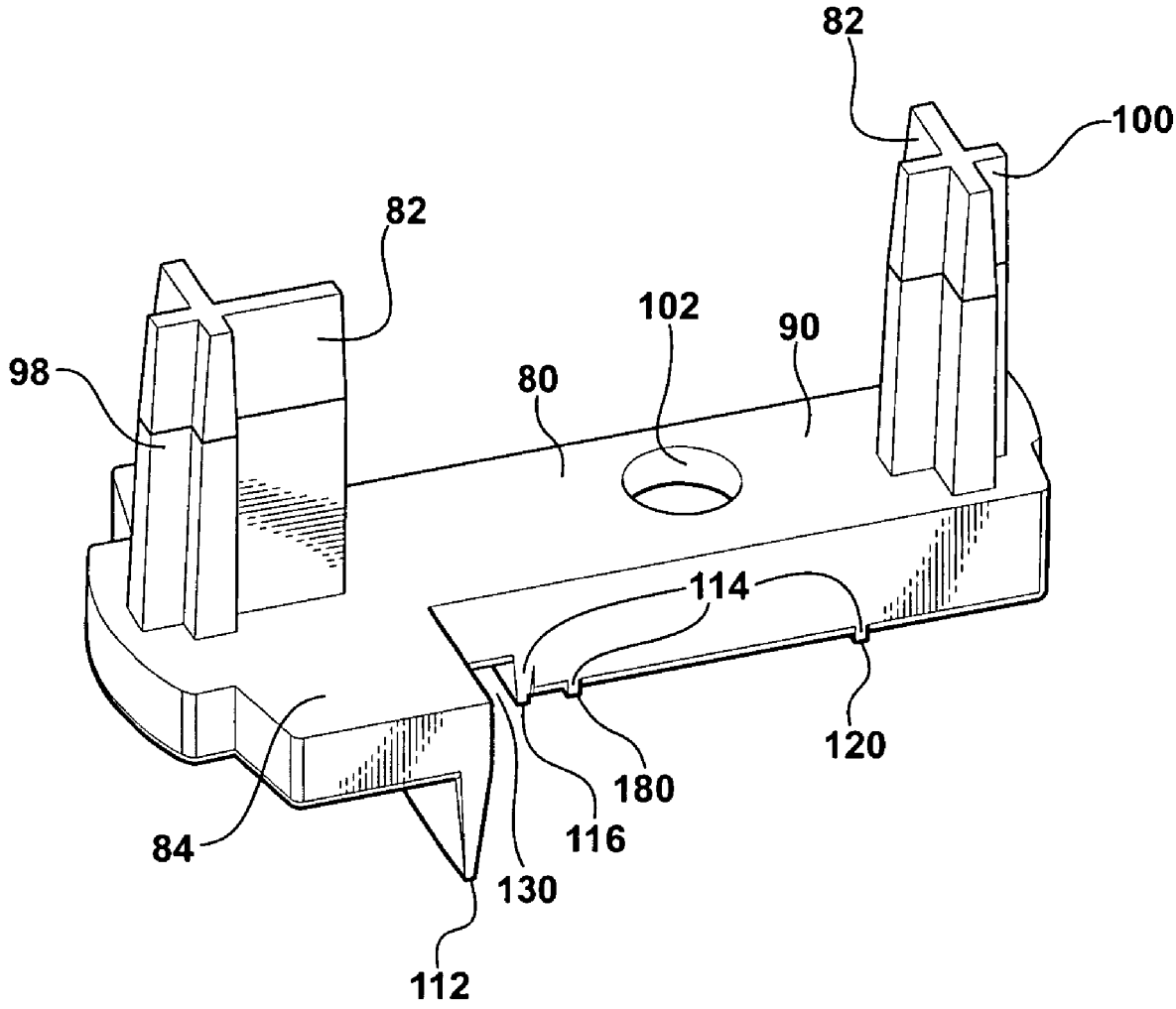
FIG. 9 is a perspective view of the astragal boot with projections that are cross-shaped and upwardly tapering.

As shown in FIGS. 6-9, the plurality of projections 82 are complementary to the profile 58 of the astragal 46 and project upwardly from the platform 80 in engagement with the walls 56 of the astragal 46 for retaining the astragal boot 48 to the lower end 50 of the astragal 46. The plurality of projections 82 include a first projection 98 and a second projection 100. The first projection 98 projects upwardly from the head portion 84 of the platform 80 and the second projection 100 projects upwardly from the base portion 90 of the platform 80. The projections 82 are spaced from one another in a direction parallel to the axis of the base portion 90 of the platform 80. The projections 82 may be tapered such that the projections 82 are press fit into the profile 58 against the walls 56 of the astragal 46. As shown in FIG. 9, the projections 82 may be cross-shaped and upwardly tapering such that the projections 82 engage the walls 56 of the astragal 46. The astragal boot 48 is removable from the lower end 50 of the astragal 46 such that the astragal boot 48 may be replaced if the astragal boot 48 becomes damaged or worn.

The platform 80 defines a hole 102 spaced from the straight edge 86 of the head portion 84 of the platform 80 and from the distal extremity 92 of the base portion 90 of the platform 80 for sliding a lock bolt 104 through the hole 102 to secure the semi-active door 38 in the closed position. The lock bolt 104 is slideable within the astragal 46. When the semi-active door 38 is in the closed position the lock bolt 104 may be slid along the astragal 46 and through the hole 102 in the platform 80 to engage a keeper in the threshold 42. The semi-active door 38 may not rotate relative to the threshold 42 when the lock bolt 104 is engaged with the keeper. The semi-active door 38 may rotate relative to the frame 24 of the door assembly 22 when the lock bolt 104 is disengaged with the keeper in the threshold 42.

As seen in FIGS. 5-8, the astragal boot 48 includes a plurality of base fins 106, a head fin 112, a primary fin 114, and a skirt 122. As shown in these Figures, the primary fin 114 is a plurality of primary fins 114, specifically three primary fins 114, which are described additionally below in the context of a preferred embodiment. However, it is to be understood that the astragal boot 48 may include any number of primary fins 114 so long as suitable mating and/or sealing with the threshold 42 can be established. As non-limiting examples, the astragal boot 48 may include only one primary fin 114 or may include more than three primary fins 114, such as four or five primary fins 114.

The plurality of base fins 106 are flexible and project downwardly from the base portion 90 of the platform 80 for sealing engagement with the threshold 42. More specifically, the plurality of base fins 106 includes a curved fin 108 joined to and extending across the curved distal extremity 92 of the base portion 90 and between the sides 52 of the base portion 90 and a pair of spaced lateral fins 110 extending from the curved fin 108 along the sides 52 of the base portion 90. The lateral fins 110 are in parallel relationship to one another. The curved fin 108 and the lateral fins 110 project an equal distance from the platform 80 and the lateral fins 110 seal against the threshold 42 when the semi-active door 38 is in the closed position. The door sweeps 94 on the active door 40 and the semi-active door 38 seal against the lateral fins 110 such that elements may not penetrate between the door sweeps 94 and the lateral fins 110 and into the building 30.

The skirt 122 projects downwardly from the platform 80 and extends around the head portion 84 complementary to the head fin 112 between the opposite ends 88 of the straight edge 86 of the head portion 84.

The skirt 122 projects downwardly from the platform 80 and extends around the head portion 84 complimentary to the head fin 112 between the opposite ends 88 of the straight edge 86 of the head portion 84.

The plurality of primary fins 114 are flexible and project downwardly from the platform 80 a greater distance than the base fins 106 and are joined to and extend between the lateral fins 110. As alluded to above, the plurality of primary fins 114 more specifically include a first primary fin 116, a second primary fin 118, and a third primary fin 120. The first primary fin 116 is flexible and projects downwardly from the platform 80 a greater distance than the lateral fins 110. The first primary fin 116 is joined to and extends between the lateral fins 110 for flexing against the threshold 42 in sealing engagement with the threshold 42 to form a cavity 124 between the lateral fins 110 and the first primary fin 116 and the platform 80 for disposition over the threshold 42. More specifically, the cavity 124 is further defined by a first cavity 126 and a second cavity 128. These first and second cavities 126, 128 are described additionally below. It should be appreciated that the primary fins 114 may be continuous with, i.e., integral with, and attached to the lateral fins 110. Alternatively, the primary fins 114 may be discontinuous with the lateral fins 110 and adjacent to and in contact with the lateral fins 110. For example, the primary fins 114 may be discontinuous from the lateral fins 110 and tightly pressed against the lateral fins 110. It should also be appreciated that the number of cavities 124 formed in the astragal boot 48 vary depending on the number of primary fins 114 that exist in the particular astragal boot 48. As already described above, the number of primary fins 114 can vary and, therefore, the number of cavities 124 segregated by the primary fins 114 can also vary.

The second primary fin 118 is flexible and projects downwardly from the platform 80 a greater distance than the lateral fins 110 and is joined to and extends between the lateral fins 110 in spaced relationship to the first primary fin 116 to form the first cavity 126 between the lateral fins 110 and the first primary fin 116 and the second primary fin 118 and the platform 80 for disposition over the threshold 42. Likewise, the third primary fin 120 is flexible and projects downwardly from the platform 80 a greater distance than the lateral fins 110 and is joined to and extends between the lateral fins 110 in spaced relationship to the second primary fin 118 to form the second cavity 128 between the lateral fins 110 and the second primary fin 116 and the third primary fin 120 and the platform 80 for disposition over the threshold 42.

More specifically, the first primary fin 116 and the second primary fin 118 and the third primary fin 120 are in parallel relationship with one another. The lateral fins 110 are generally perpendicular to the primary fins 116, 118, 120 and the head fin 112 is in parallel relation with the primary fins 116, 118, 120. When the semi-active door 38 and the active door 40 are in the closed position, the astragal boot 48 completes the seal against the threshold 42 between the door sweep 94 on the semi-active door 38 and the door sweep 94 on the active door 40 to continuously seal against the threshold 42 between the first vertical member 32 and the second vertical member 34 of the frame 24 to prevent penetration of elements into the building 30.

The head fin 112 prevents a major portion of the elements from penetrating between the astragal boot 48 and the threshold 42 into the building 30. The first primary fin 116 and the lateral fins 110 prevent further penetration of elements that penetrate between the head fin 112 and the threshold 42 from penetrating below the astragal boot 48 and into the building 30. More specifically, the primary fins 116, 118, 120 flex against the threshold 42 and the lateral fins 110 hold the primary fins 116, 118, 120 in contact with the threshold 42 because the primary fins 116, 118, 120 are thinner than the lateral fins 110 and the primary fins 116, 118, 120 are joined to the lateral fins 110 and project away from the platform 80 farther than the lateral fins 110. Likewise, the effort required to swing the semi-active door 38 to the closed position is minimized because the primary fins 116, 118, 120 are thinner than the lateral fins 110 and may flex easily against the threshold 42.

If the first primary fin 116 becomes worn or obstructed, then the elements that penetrate below the main fin may also penetrate between the first primary fin 116 and the threshold but will be prevented from penetrating into the building 30 by the second primary fin 118. Likewise, if both the first primary fin 116 and the second primary fin 118 are worn or obstructed then the elements that may penetrate below the main fin and the first primary fin 116 and the second primary fin 118 is prevented from penetrating into the building 30 by the third primary fin 120.

The head fin 112 is spaced from the first primary fin 116 to define a channel 130 between the head fin 112 and the first primary fin 116 for receiving the head fin 112 in the channel 130 when the head fin 112 flexes against the threshold 42 and into the channel 130 when the head fin 112 passes over the threshold 42. More specifically, when the semi-active door 38 and the astragal assembly 20 are swung from an open position to a closed position, the head fin 112 passes over the threshold 42. Over portions of the threshold 42 the head fin 112 contacts the threshold 42 and flexes against the threshold 42 and into the channel 130 as the swing of the semi-active door 38 and the astragal assembly 20 is continued.

Finally, it is to be understood that the astragal boot 48 can be an integral component, i.e., a one-piece component, or can be formed of more than one component. Where the astragal boot 48 is formed of more than one component, the astragal boot 48 is typically two components where the platform 80 of the astragal boot 48 is a generally rigid component and the fins 106, 112, 114 and/or the skirt 122 are generally flexible components formed of a polymeric material that is molded over the platform 80. In this scenario, the fins 106, 112, 114 and/or the skirt 122 can be co-molded with the platform 80.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

The invention claimed is:

1. An astragal boot for mounting onto a lower end of an astragal disposed at a free end of a semi-active door in a double-door set disposed over a threshold, said astragal boot comprising;

a platform, a pair of spaced lateral fins being flexible and projecting downwardly from said platform for sealing engagement with the threshold, a first primary fin being flexible and projecting downwardly from said platform a greater distance than said lateral fins and directly joined to and extending between said lateral fins for flexing against the threshold in sealing engagement with the threshold to form a cavity between said lateral fins and said first primary fin and said platform for disposition over the threshold, and a second primary fin disposed in said cavity and being flexible and projecting downwardly from said platform a greater distance than said lateral fins and directly joined to and extending between said lateral fins in said cavity in spaced relationship to said first primary fin.

2. An astragal boot as set forth in claim 1 wherein a cavity is defined between said lateral fins and said first primary fin and said second primary fin and said platform for disposition over the threshold.

3. An astragal boot as set forth in claim 1 including a third primary fin being flexible and projecting downwardly from said platform a greater distance than said lateral fins and joined to and extending between said lateral fins in spaced relationship to said second primary fin to form a second cavity between said lateral fins and said second primary fin and said third primary fin and said platform for disposition over the threshold.

4. An astragal boot as set forth in claim 3 wherein said first primary fin, said second primary fin, and said third primary fin are in parallel relationship with one another.

5. An astragal boot as set forth in claim 4 wherein said lateral fins are in parallel relationship to one another and perpendicular to said primary fins.

6. An astragal boot as set forth in claim 1 wherein said platform is defined by a head portion presenting a straight edge having opposite ends and a base portion extending from said straight edge along an axis generally perpendicular to said straight edge to a curved distal extremity.

7. An astragal boot as set forth in claim 6 wherein said base portion has sides narrower than said head portion for receiving door sweeps adjacent each of said sides of said base portion.

8. An astragal boot as set forth in claim 7 wherein said base portion defines a hole spaced from said straight edge and from said distal extremity for sliding a lock bolt through said hole to secure the semi-active door in a closed position.

9. An astragal boot as set forth in claim 8 including a third primary fin each being flexible and projecting downwardly from said platform a greater distance than said lateral fins and joined to and extending between said lateral fins in spaced relationship with said first primary fin and with said second primary fin wherein said hole is defined in said base portion between said second primary fin and said third primary fin.

10. An astragal boot as set forth in claim 7 including a head fin being flexible and projecting downwardly from said platform between said opposite ends of said straight edge of said head portion of said platform for parallel and overlapping sealing engagement with the door sweeps.

11. An astragal boot as set forth in claim 10 wherein said head fin is spaced from said first primary fin to define a channel between said head fin and said first primary fin for receiving said head fin in said channel when said head fin flexes against the threshold and into said channel when said head fin passes over the threshold.

12. An astragal boot as set forth in claim 11 wherein said head fin is in parallel relation with said first primary fin.

13. An astragal boot as set forth in claim 10 including a curved fin joined to and extending across said curved distal extremity of said base portion and between said sides of said base portion.

14. An astragal boot as set forth in claim 13 including a skirt projecting downwardly from said platform and extending around said head portion complementary to said head fin between said opposite ends of said straight edge of said head portion.

15. An astragal boot as set forth in claim 10 wherein said lateral fins project downwardly from said base portion of said platform.

16. An astragal boot comprising;

a platform defined by a head portion presenting a straight edge having opposite ends and a base portion having sides narrower than said head portion extending from said straight edge along an axis perpendicular to said straight edge to a curved distal extremity, said platform defining a hole spaced from said straight edge and from said distal extremity, a first projection projecting upwardly from said head portion of said platform and a second projection spaced from said first projection projecting upwardly from said base portion of said platform, a head fin being flexible and projecting downwardly from said platform along and between said opposite ends of said straight edge of said head portion of said platform, a skirt projecting downwardly from said head portion of said platform and extending around said head portion complementary to said head fin between said opposite ends of said straight edge of said head portion, a plurality of base fins being flexible and projecting downwardly from said base portion of said platform, said plurality of base fins including a curved fin joined to and extending across said curved distal extremity of said base portion and between said sides of said base portion, said plurality of base fins including a pair of spaced lateral fins extending from said curved fin along said sides of said base portion, a plurality of primary fins being flexible and projecting downwardly from said platform a greater distance than said base fins and joined to and extending between said lateral fins in parallel relationship with said head fin, said plurality of primary fins including a first primary fin spaced from said head fin to define a channel between said first primary fin and said head fin, said plurality of fins including a second primary fin in spaced relationship to said first primary fin, said plurality of fins including a third primary fin in spaced relationship to said second primary fin, whereby said first projection and said second projection are engageable with a profile defined by a lower end of an astragal to retain said astragal boot to the lower end of the astragal disposed at a free end of a semi-active door in a double door set disposed over a threshold for sliding a lock bolt through said hole to secure the semi-active door in a closed position and for receiving door sweeps adjacent each said sides of said base portion with said head fin in parallel and overlapping sealing engagement with the door sweeps and flexed against the threshold and into said channel when said head fin passes over the threshold and said base fins are in sealing engagement with the threshold and said plurality of primary fins flex against the threshold to form a first cavity between said lateral fins and said first primary fin and said second primary fin and said platform for disposition over the threshold and to form a second cavity between said lateral fins and said second primary fin and said third primary fin and said platform for disposition over the threshold.

17. An astragal assembly for disposition on a free end of a semi-active door in a double-door set disposed over a threshold, said astragal assembly comprising;

an astragal presenting a lower end proximal to the threshold and walls extending upwardly from said lower end defining a profile, an astragal boot including a platform and a plurality of projections complementary to said profile projecting upwardly from said platform in engagement with said walls, said astragal boot including a pair of spaced lateral fins being flexible and projecting downwardly from said platform for sealing engagement with the threshold, said astragal boot including a first primary fin being flexible and projecting downwardly from said platform a greater distance than said lateral fins and directly joined to and extending between said lateral fins for flexing against the threshold in sealing engagement with the threshold to form a cavity between said lateral fins and said first primary fin and said platform for disposition over the threshold, and said astragal boot includes a second primary fin disposed in said cavity and being flexible and projecting downwardly from said platform a greater distance than said lateral fins and directly joined to and extending between said lateral fins in said cavity in spaced relationship to said first primary fin.

18. An astragal assembly as set forth in claim 17 wherein a cavity is defined between said lateral fins and said first primary fin and said second primary fin and said platform for disposition over said threshold.

19. An astragal assembly as set forth in claim 17 wherein said astragal boot includes a third primary fin being flexible and projecting downwardly from said platform a greater distance than said lateral fins and joined to and extending between said lateral fins in spaced relationship to said second primary fin to form a second cavity between said lateral fins and said second primary fin and said third primary fin and said platform for disposition over the threshold.

20. An astragal assembly as set forth in claim 19 wherein said first primary fin and said second primary fin and said third primary fin are in parallel relationship with one another.

21. An astragal assembly as set forth in claim 20 wherein said lateral fins are in parallel relationship to one another and perpendicular to said primary fins.

22. An astragal assembly as set forth in claim 17 wherein said platform is defined by a head portion presenting a straight edge having opposite ends and a base portion extending from said straight edge along an axis generally perpendicular to said straight edge to a curved distal extremity and wherein said base portion has sides narrower than said head portion for receiving door sweeps adjacent each of said sides of said base portion.

23. An astragal assembly as set forth in claim 22 including a head fin being flexible and projecting downwardly from said platform between said opposite ends of said straight edge of said head portion of said platform for parallel and overlapping sealing engagement with the door sweeps and wherein said lateral fins project downwardly from said base portion of said platform.

* * * * *

UNITED STATES PATENT AND TRADEMARK OFFICE

CERTIFICATE OF CORRECTION

PATENT NO. : 7,788,863 B2
APPLICATION NO. : 11/244786
DATED : September 7, 2010
INVENTOR(S) : Michael E. Pepper et al.

It is certified that error appears in the above-identified patent and that said Letters Patent is hereby corrected as shown below:

In Column 8, line 6, in Claim 9, delete "primary fin each being" and please replace with -- primary fin being --.

Signed and Sealed this
Eighth Day of March, 2011

David J. Kappos

David J. Kappos
*Director of the United States Patent and Trademark Office*